US007788763B2

(12) United States Patent
Hwang

(10) Patent No.: US 7,788,763 B2
(45) Date of Patent: Sep. 7, 2010

(54) FAN MOTOR NOISE REDUCTION DEVICE AND VACUUM CLEANER WITH THE SAME

(75) Inventor: Jung Bai Hwang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1024 days.

(21) Appl. No.: 11/099,541

(22) Filed: Apr. 6, 2005

(65) Prior Publication Data

US 2006/0117518 A1 Jun. 8, 2006

(30) Foreign Application Priority Data

Dec. 3, 2004 (KR) ..... 10-2004-0100895

(51) Int. Cl.

| | |
|---|---|
| ***A47L 5/00*** | (2006.01) |
| ***A47L 9/00*** | (2006.01) |
| ***A47L 9/22*** | (2006.01) |
| ***F01N 3/02*** | (2006.01) |
| ***F01N 3/06*** | (2006.01) |

(52) U.S. Cl. ..... 15/326; 15/412; 181/202; 181/225; 181/231; 415/119

(58) Field of Classification Search ..... 15/336, 15/412, 300.1–404, 326; 181/202, 225, 231; 415/119; 417/313, 572; 310/248
See application file for complete search history.

(56) References Cited

U.S. PATENT DOCUMENTS

| | | | | |
|---|---|---|---|---|
| 2,272,985 | A * | 2/1942 | Smith | 15/326 |
| 2,731,194 | A * | 1/1956 | Kent | 181/225 |
| 3,599,273 | A * | 8/1971 | Shirayanagi et al. | 15/326 |
| 5,159,738 | A * | 11/1992 | Sunagawa et al. | 15/326 |
| 5,293,664 | A * | 3/1994 | Lim et al. | 15/326 |
| 5,720,074 | A * | 2/1998 | Lee | 15/326 |
| 5,991,969 | A * | 11/1999 | Lee | 15/326 |
| 6,070,289 | A * | 6/2000 | Lee et al. | 15/326 |
| 6,611,989 | B2 * | 9/2003 | Oh et al. | 15/326 |
| 2002/0056169 | A1 * | 5/2002 | Kushida et al. | 15/319 |
| 2003/0155837 | A1 * | 8/2003 | Takahashi et al. | 310/253 |
| 2004/0025287 | A1 * | 2/2004 | McCormick et al. | 15/353 |
| 2005/0022337 | A1 * | 2/2005 | Roney et al. | 15/412 |
| 2005/0097702 | A1 * | 5/2005 | Ni | 15/326 |

FOREIGN PATENT DOCUMENTS

| | | |
|---|---|---|
| DE | 198 43 719 | 9/1998 |
| EP | 0 453 296 | * 10/1991 |

(Continued)

*Primary Examiner*—Bryan R Muller
(74) *Attorney, Agent, or Firm*—Ked & Associates LLP

(57) ABSTRACT

A vacuum cleaner includes a fan motor generating air current, a main body receiving the fan motor, a wheel allowing the main body to smoothly move, a flexible connecting hose extending from the main body, an expandable extending tube connected to the connecting holes, a suction nozzle connected to an end of the extending tube to suck outer air, an inner sound absorption member disposed around the fan motor to absorb noise generated by the fan motor, a casing disposed around the inner sound absorption member to enclose the fan motor, the casing being provided with an air hole through which the air is exhausted in a side direction of the fan motor, and an outer sound absorption member disposed around the casing to absorb the noise generated by the fan motor.

23 Claims, 4 Drawing Sheets

FOREIGN PATENT DOCUMENTS

| | | |
|---|---|---|
| EP | 0528451 | 2/1993 |
| EP | 0910980 | 4/1999 |
| JP | 05253113 | 10/1993 |
| JP | 06304097 | 1/1994 |
| JP | 070161763 | 1/1995 |

* cited by examiner

FAN MOTOR NOISE REDUCTION DEVICE AND VACUUM CLEANER WITH THE SAME

BACKGROUND OF THE INVENTION

1. Field of the Invention

The present invention relates to a fan motor noise reduction device for a vacuum cleaner, and more particularly, to a fan motor noise reduction device that can reduce the noise of a vacuum cleaner by preventing the noise generated in the fan motor from being transmitted out of the fan motor.

2. Description of the Related Art

Generally, a vacuum cleaner is a device for collecting foreign objects such as dust in a dust bag using powerful suction force of a fan motor.

A prior vacuum cleaner includes a nozzle unit to which outer air is introduced and a cleaner body through which the outer air introduced into the nozzle unit is exhausted after foreign objects contained in the outer air are filtered out. The cleaner body receives a fan motor comprised of a suction fan and a motor that are integrated in a single body. The suction fan functions to generate suction force for allowing outer air to be forcedly introduced through the nozzle unit.

When the vacuum cleaner is operated, a large amount of noise is generated. The noise is generally caused by friction between parts of the fan motor, collision between the fan and the air, and airflow. In order to reduce such noise, a variety of developments have been proposed. For example, it has been attempted to reduce the noise by modifying the design of the fan motor. It has also been attempted to exclude the noise by providing an additional noise reduction member preventing the noise from being transmitted to an external side of the vacuum cleaner. However, the former has a problem in that the manufacturing cost of the motor is increased.

Therefore, a noise reduction device that prevents noise from being transmitted out of the fan motor has been developed.

According to prior art, a sound absorption member such as cotton is disposed around the fan motor to absorb the noise or the fan motor is received in an enclosed housing to prevent the noise from being transmitted to an external side. However, these cannot satisfy the consumer's requirements. That is, there is still 69-80 db noise around the fan motor.

SUMMARY OF THE INVENTION

Accordingly, the present invention is directed to a fan motor noise reduction device for a vacuum cleaner, which substantially obviate one or more problems due to limitations and disadvantages of the related art.

It is an object of the present invention to provide a noise reduction device for a vacuum cleaner, which can reduce the noise by preventing the noise from being transmitted to an external side of the vacuum cleaner, thereby reducing an amount of noise transmitted to a user.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a vacuum cleaner comprising: a fan motor generating air current; a main body receiving the fan motor; a wheel allowing the main body to smoothly move; a flexible connecting hose extending from the main body; an expandable extending tube connected to the connecting holes; a suction nozzle connected to an end of the extending tube to suck outer air; an inner sound absorption member disposed around the fan motor to absorb noise generated by the fan motor; a casing disposed around the inner sound absorption member to enclose the fan motor, the casing being provided with an air hole through which the air is exhausted in a side direction of the fan motor; and an outer sound absorption member disposed around the casing to absorb the noise generated by the fan motor.

In another aspect of the present invention, there is provided a vacuum cleaner comprising: a fan motor receiving air through a front portion and exhausting the air in a radial direction; a main body receiving the fan motor; a wheel provided on a lower portion of the main body to allow the main body to smoothly move; a flexible connecting hose extending from the main body; a suction nozzle directing outer air to the connecting hose by contacting a flour bottom; a casing enclosing the fan motor, the casing being provided with an air hole through which the air passes and expands to reduce noise; and a sound absorption member provided on an inner and/or outer portion of the casing.

In a still another aspect of the present invention, there is provided a noise reduction device for a vacuum cleaner, comprising: a fan motor comprising a motor unit for generating rotational force and an impeller unit rotating by the rotational force generated by the motor unit and installed on the front supporting member; a casing disposed around the fan motor and spaced away from the fan motor, the casing being provided with an air hole allowing the air to be exhausted in a side direction of the fan motor; an inner sound absorption member formed on an inner portion of the casing to absorb the noise; and an outer sound absorption member formed on an outer portion of the casing to absorb the noise.

In a still yet another aspect of the present invention, there is provided a noise reduction device for a vacuum cleaner, comprising: a cylindrical fan motor, to a front portion of which the air is introduced; a casing disposed around the fan motor to enclose the fan motor, the casing being provided with an air hole allowing the air to be exhausted in a side direction of the fan motor; and a sound absorption member disposed on an inner and/or outer sides of the casing.

According to the present invention, noise generated from the fan motor of the vacuum cleaner is remarkably reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
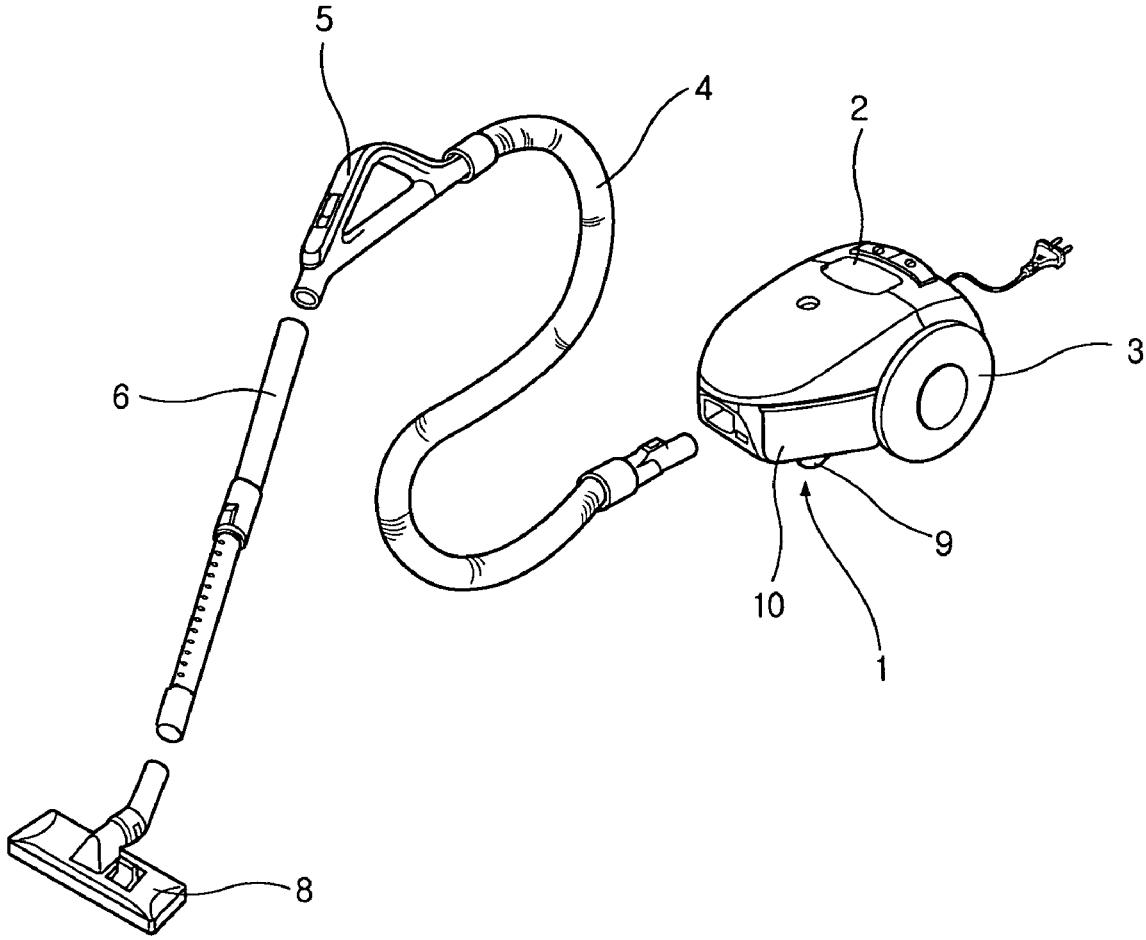
FIG. 1 is a perspective view of a vacuum cleaner according to an embodiment of the present invention.

FIG. 1 shows a perspective view of a vacuum cleaner according to an embodiment of the present invention.

Referring to FIG. 1, the inventive vacuum cleaner includes a main body 1 having a lower cover 10 with a fan motor, a flexible connecting hose 4 communicating with an interior side of the main body 1, an extendable tube 6 connected to the connecting hose 4, and a suction nozzle 8 coupled to an end of the extendable tube 6 to suck foreign objects by contacting a floor. Main wheels 3 and sub-wheels 9 are installed on a bottom of the main body 1 to direct the vacuum cleaner to a desired direction.

In order to move the cleaner to another place while using the cleaner, the user grasps a hose handle 5 formed on the connecting hose 4 and moves the cleaner. However, when the place to which the cleaner will be moved is not flat, the user grasps the grasping portion 2 defined by concaving a top of the main body 2 and lifts the main body 2 to move the same.

The fan motor received in the main body 1 generates suction force to suck outer air. The fan motor generates a large amount of noise. Therefore, a noise reduction device is provided around the fan motor.

A noise reduction device of the present invention is designed to reduce the noise by lengthening a noise path and providing a variable width (a variable section) to the noise path. The noise reduction device having the variable section is called an expanding type noise reduction device.

A noise transmission loss of the expanding type noise reduction device can be illustrated by the following equation 1.

$$TL = 10\log\left[1 + \frac{1}{4}\left(m - \frac{1}{m}\right)^2 \sin^2 KL\right]\text{dB} \qquad \text{[EQUATION 1]}$$

where, TL is the transmission loss;

m is a section ratio (A2/A1) (A2 is a sectional area of the expanded portion and A1 is a sectional area of the contracted portion);

K is $2\pi$ f/c (f is a noise frequency and c is the speed of sound); and

L is a whole length of the expanded portion.

Referring to Equation 1, it can be noted that the more the m, the better the noise transmission loss. However, since it is impossible to unlimitedly increase the sectional area of the expanded portion, it is limited to improve the transmission loss by increasing the sectional are of the expanded portion. In addition, the longer the length L, the better the noise transmission loss. However, since it is also impossible to increase the length L, it is limited to improve the transmission loss by increasing the length L of the expanded portion.

Furthermore, since the noise generated in the fan motor has a variety of frequencies, it is difficult to eliminate all of the frequencies.

Under this background, the present invention proposes a noise reduction device that can properly adjust the section ratio m and lengthen the whole length of the expanded portion as long as possible. The inventive noise reduction device will be described in more detail in conjunction with the accompanying drawings.

Figure 2:
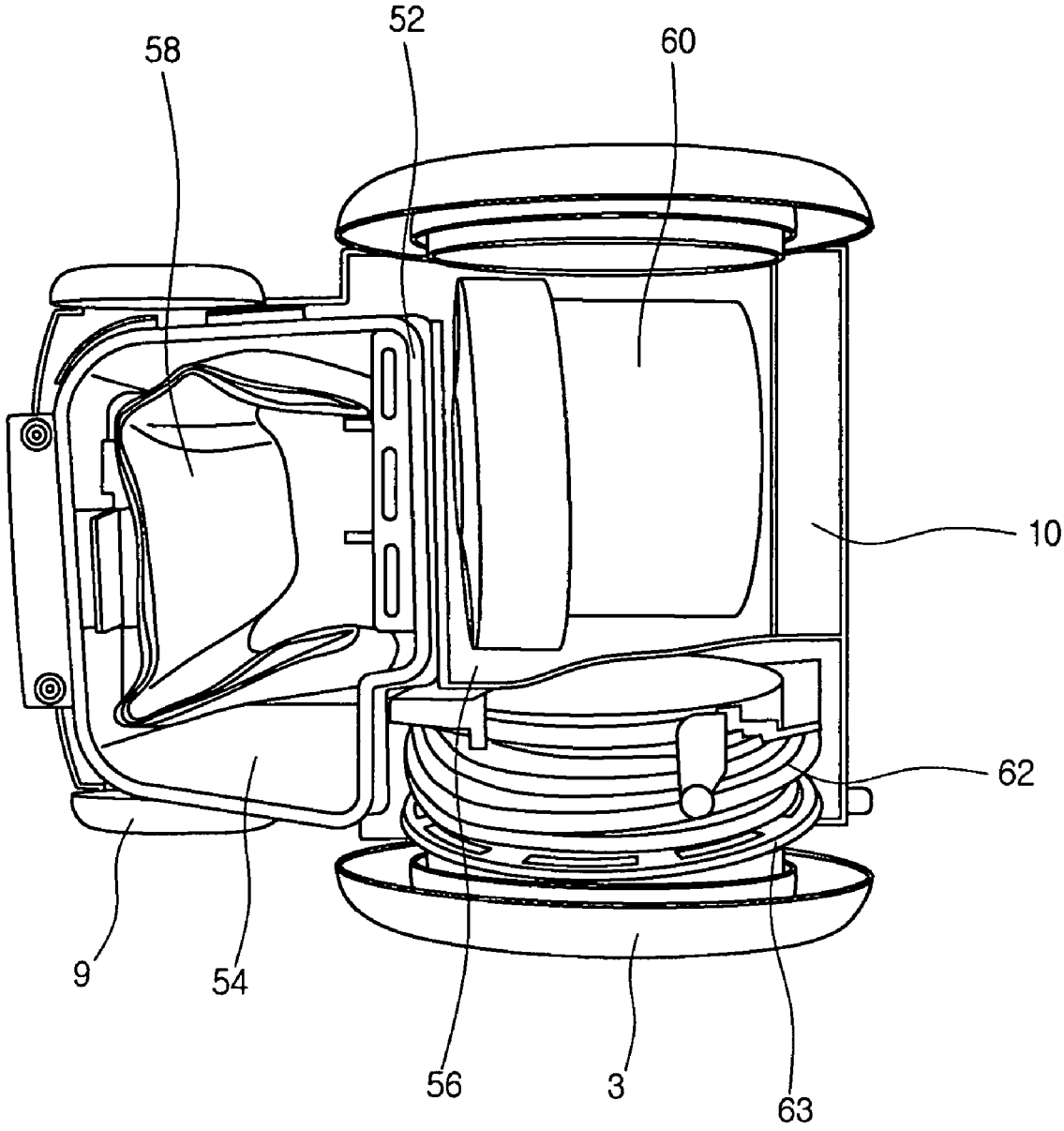
FIG. 2 is a plane view of a vacuum cleaner, illustrating a motor employing a noise reduction device according to an embodiment of the present invention.

FIG. 2 shows a plane view of a vacuum cleaner, illustrating a motor employing a noise reduction device according to an embodiment of the present invention.

Referring to FIG. 2, a plurality of spaces are defined in the lower cover 10. That is, a barrier 52 is formed on a center of the main body 1. A dust collection chamber 54 is defined in front of the barrier 52 and a power generation chamber 56 creating the suction force making the airflow is defined in rear of the barrier 52.

Describing in more detail, a dust bag 58 for filtering out the foreign objects contained in the air is disposed in the dust collection chamber 54. A cord reel 63 for receiving a wound power cord 62 is provided on a side of the fan motor 60. The wheels 3 and 9 are provided on other opposite end of the main body 1 to make it easy to move the main body 1. That is, the main wheels 3 are installed on rear opposite ends of the main body 1 and the sub-wheels 9 each having a diameter less than that of the main wheel 3 are installed on front opposite ends of the main body 1.

The operation of the above-described vacuum cleaner will be described hereinafter.

When the fan motor 60 is operated, a negative pressure atmosphere is formed in the power generation chamber 56. The negative pressure atmosphere is transmitted to the dust collection chamber 54 so that outer air can be introduced into the dust collection chamber 54. The outer air introduced into the dust collection chamber 54 passes through the dust bag 58, in the course of which the foreign objects contained in the air is filtered out by the dust bag 58. The outer air passed through the dust collection chamber 54 is directed toward the fan motor 60 to cool down the fan motor 60 and is then exhausted out of the vacuum cleaner.

Meanwhile, the fan motor 60 is provided with a noise reduction device that will be described in more detail hereinafter.

Figure 3:
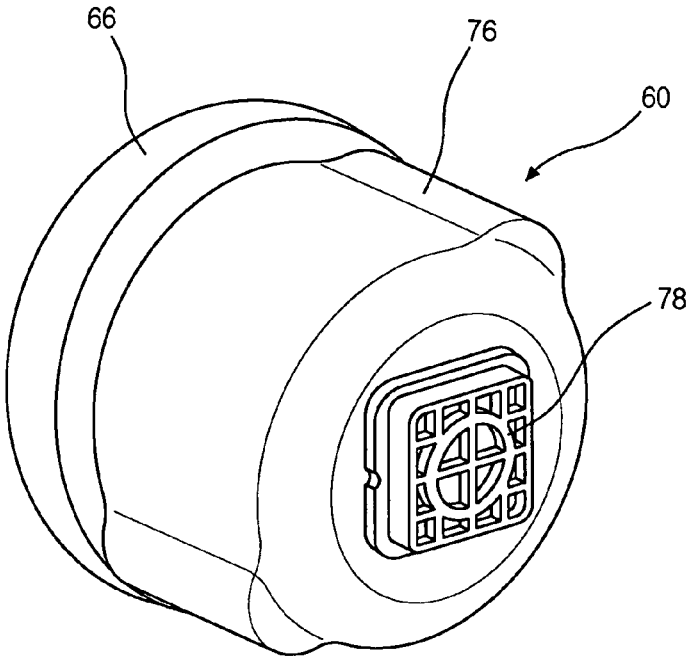
FIG. 3 is a perspective view of a noise reduction device according to an embodiment of the present invention.
Figure 4:
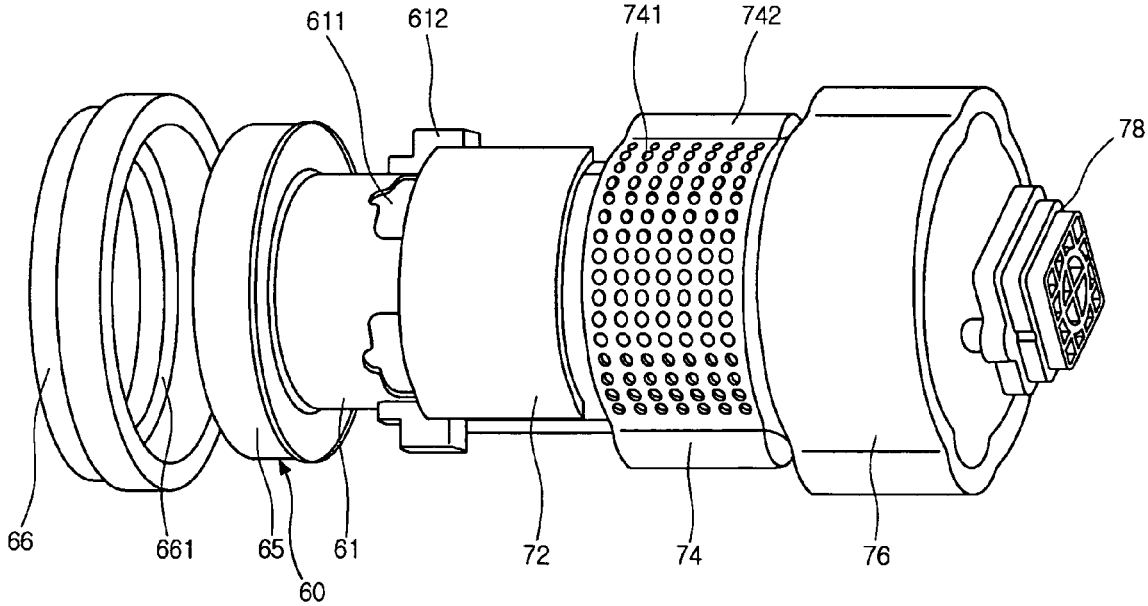
FIG. 4 is an explode perspective view of a noise reduction device depicted in FIG. 3.

FIGS. 3 and 4 show the noise reduction device according to the present invention.

Referring to FIGS. 3 and 4, the fan motor 60 is formed in a cylindrical shape, including a motor unit 61 having a plurality of parts such as a stator and a rotor that are used to generate rotational force and an impeller unit 65 connected to the motor unit 61 by a shaft to generate suction force by creating air current using the rotational force of the motor unit 61.

That is, an impeller rotating by the rotational force of the motor unit 61 is installed in the impeller unit 65. An outer circumference of the impeller unit 65 has a diameter greater than that of the motor unit 61 to introduce a relatively large amount of the outer air. The motor unit 61 is provided at an outer circumference with a plurality of exhaust windows 611 through which the air introduced through a front portion of the impeller unit 65 is exhausted. A brush fixing portion 612 is projected outward from a side portion of the exhaust window 611.

Describing in more detail, a front supporting member 66 is provided on a front end of the impeller unit 65. The front supporting member 66 is preferably formed of elastic material such as rubber. A stepped surface 661 is formed in the front supporting member 66. A front edge of the impeller unit 65 closes contacts the stepped surface 661. As described above, the front supporting member 66 encloses the front edges of the impeller unit 65. A front surface of the front supporting member 66 contacts a rear surface of the barrier 52 (a front portion of the power generation chamber 56). Accordingly, since the front portion of the fan motor 60 is supported by the front supporting member 66, the vibration generated in the fan motor 60 can be attenuated. That is, the front supporting member 66 functions as an damping member for damping the vibration transmission between the fan motor 60 and the barrier 52.

That is, a noise reduction device is further formed on an outer surface of the fan motor 60 to reduce the fan motor noise. The noise reduction device includes an inner sound absorption member 72, a casing 74 and an outer sound absorption member 76. This will be described in more detail hereinafter.

The inner sound absorption member 72 is disposed on an outer circumference of the motor unit 61 of the fan motor 60. The inner sound absorption member 72 may be formed of polyethylene or polyurethane in the form of sponge that is a synthetic foam body having flexible and elastic property or cotton.

The inner sound absorption member 72 has a 1-10 mm thickness. Particularly, it was proved through a test that, when the inner sound absorption member was designed having a 2-7 mm thickness, the sound absorption was most efficient. When the thickness is less than 2 mm, the sound absorption effect is deteriorated, and when greater than 7 mm, the space efficiency is deteriorated.

The casing 74 is disposed around the inner sound absorption member 72. The casing 74 is preferably formed of plastic having predetermined strength. The casing 74 is formed in a cap shape enclosing the motor unit 61 of the fan motor 60. That is, the casing 74 has an opened front portion and a rear portion having a hole in which the rear supporting member 78 is mounted. The casing 74 has proper strength so as to prevent its shape, the inner sound absorption member 72 and the outer sound absorption member 76 from being deformed by the air current and constant air pressure generated through the exhaust windows 611, thereby allowing the air to be uniformly exhausted through air holes 741. That is, as the casing 74 and the sound absorption members 72 and 76 maintain their original shapes, the noise absorption effect can be maintained.

The casing 74 has preferably a 1-5 mm thickness, more preferably, a 2.5-3.5 mm thickness. In the test, it was noted that, when the thickness of the casing 74 is 3 mm, the lowest noise level was obtained. The thickness of the casing 74 functions as an expanded air path. The longer the casing 74, the lower the noise level. However, when the casing is too long, it is difficult to manipulate the casing and the heat of the motor is not quickly cooled.

A thickness test result of the casing 74 will be described hereinafter.

In a state where all other conditions are identical, when the thickness of the casing 74 was 2 mm, 56.865 dB noise was generated. When the thickness of the casing 74 was 3 mm, 56.43 dB was measured. This shows that the most preferable thickness of the casing 74 is 3 mm. In the test, the noise is measured at a bottom of the vacuum cleaner.

The air holes 741 are formed on the circumference of the casing 74. The air holes 741 function as a path through which air forcedly flows by the fan motor 60.

A diameter of each air hole 741 is preferably about 1-10 mm. It was identified through the test that, when the diameter of the air hole 741 is 5 mm, the lowest noise level is obtained. As the diameter of the air hole 741 is increased, since the diameter of the casing 74 is increased compared with that of the inner sound absorption member 72, the noise reduction efficiency may be increased. However, as the diameter is increased, the strength of the casing 74 is reduced and the constant airflow speed through the casing 74 is deteriorated. In a state where all other conditions are identical, when the diameter of the air hole 741 was 4 mm, 60.6 dB noise was generated. When the diameter of the air hole 741 was 5 mm, 60.18 dB noise was measured.

The casing 74 is provided with two receiving portions 742 projected outward. The receiving portions 742 are shaped corresponding to the shape of the brush fixing portion 612 of the fan motor 60 to receive the brush fixing portion 612 therein. The receiving portions 742 function to accurately dispose the casing 74 around a portion spaced away from the fan motor 60. However, when the fan motor 60 employs a brushless motor, the receiving portions may not be formed.

In addition, it is preferable that the casing 74 is spaced away from the fan motor 60. Particularly, a gap is defined between the rear end of the impeller unit 65 of the fan motor 60 and the front end of the casing 74 to prevent the collision between the fan motor 60 and the casing 74, thereby preventing the generation of the noise. Preferably, the gap is about 2-3 mm.

In addition, the outer sound absorption member 76 is disposed on the outer circumference of the casing 74. Likewise the inner sound absorption member 72, the outer sound absorption member 76 also functions to absorb the noise generated from the fan motor 60. Accordingly, the outer sound absorption member 76 may be formed of polyethylene or polyurethane in the form of sponge that is a synthetic foam body having flexible and elastic property or cotton.

The outer sound absorption member 76 has a 5-15 mm thickness. Particularly, it was noted through a test that, when the outer sound absorption member 76 was designed having a 10 mm thickness, the sound absorption was most efficient. The greater the thickness of the outer sound absorption member 76, the more the noise reduction effect. However, when the thickness is too high, it is difficult to install and manipulate the outer sound absorption member 76.

As described above, by forming the inner and outer sound absorption members 72 and 76 on the casing 74, the noise reduction effect can be further improved. Furthermore, since the casing 74 is provided with the air holes, the noise reduction effect can be further improved.

Figure 5:
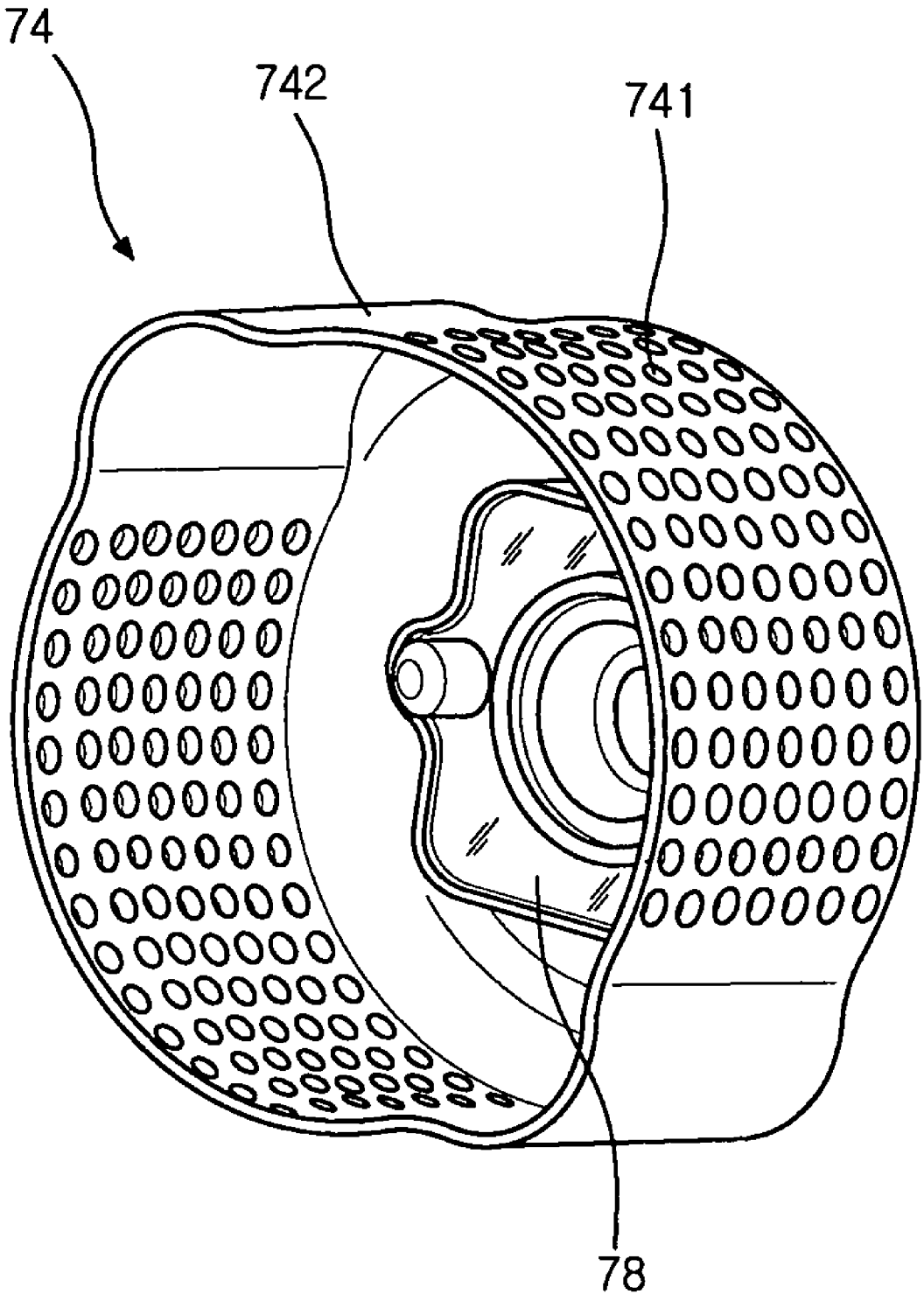
FIG. 5 is a view illustrating a coupling state of a rear supporting member and a casing.

As shown in FIG. 5, a rear supporting member 78 is provided on the casing 74.

Referring to FIG. 5, the rear supporting member 78 supports the rear portion of the fan motor 60 to prevent the vibration of the fan motor 60 from being transmitted to an external side. Preferably, the rear supporting member 78 is also formed of elastic material such as rubber. The rear supporting member 74 is installed in a hole formed on a rear portion of the casing. The fan motor 60 is supported on an inner end of the rear supporting member 78. An outer end of the rear supporting member 78 contacts the lower cover 10 to reduce the noise of the fan motor 60.

When a fan motor housing (not shown) may be formed on a portion spaced away from the outer sound absorption member 76, the noise may be further reduced.

The operational effect of the above-described fan motor noise reduction device for the vacuum cleaner will be described hereinafter.

When electric power is applied to the fan motor 60, suction force is generated by the fan motor 60 to allow outer air containing foreign objects to be introduced into the main body 1. The foreign objects are filtered out while the outer air passes through the dust bag 58. The air passed through the dust bag 58 is directed to the fan motor 60 via the barrier 52. The air directed into the fan motor 60 through the front surface of the fan motor 60 is exhausted through the exhaust windows 611 of the motor unit 61. The air exhausted through the exhaust window 611 passes through the inner sound absorption member 72 and flows outward through the air holes 741 of the casing 74. The air flowing outward through the air holes 741 is exhausted out of the main body 1 via the outer sound absorption member 76.

As described above, the air and noise generated by the fan motor 60 is exhausted via the exhaust windows 611 of the motor unit 61, the inner sound absorption member 72, the casing 74, and the outer sound absorption member 76.

As the air and noise pass through the inner and outer sound absorption members 72 and 76 and the casing 74, the noise generated by the fan motor 60 is transmitted through a relatively long transmission path by the casing 74 and absorbed by the inner and outer sound absorption members 72 and 76. Hence, the noise passes through a plurality of paths that are alternately expanded and contracted and a plurality of sound absorption members. As a result, the noise alleviation effect can be improved. Particularly, since the effect of the expanding member is improved by the plurality of air holes 741 formed on the casing 74, the noise reduction effect can be further improved.

Furthermore, as described above, it is proved by a test that, when the thicknesses of the inner sound absorption member 72, the outer sound absorption member 76 and the casing 74 were respectively set at 5 mm, 10 mm and 3 mm and a diameter of each air hole 741 was set at 5 mm, the lowest level of the noise was obtained. In this case, 53.3 dB noise was generated.

In short, the air introduced in a direction perpendicular to the fan motor 60 is exhausted through the exhaust windows 611 and the air holes 741, in the course of which, the noise is absorbed by the inner and outer sound absorption members 72 and 76.

In addition, by forming the plurality of air holes each having a relatively small size, the air passing through the air holes is momentarily expanded, thereby reducing the noise. Needless to say, the noise is further absorbed by the sound absorption members 72 and 76.

Additional inner and outer sound absorption member may be further provided or each of the inner and outer sound absorption members may be formed in a plurality of pieces.

In the present invention, by varying the sectional area of the path through which the sound waves is transmitted, the sound waves are reflected and interfered from each other, thereby reducing the noise.

As the noise and vibration are attenuated in the vacuum cleaner of the present invention, the user can use the vacuum cleaner in the pleasant surroundings.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A vacuum cleaner, comprising:

a fan motor that generates air current, including a motor that generates a rotational force and at least one brush fixing portion provided on a peripheral surface thereof and an impeller that rotates via the rotational force generated by the motor;

a main body that receives the fan motor;

a flexible connecting hose that extends from the main body;

an expandable extending tube connected to the connecting hose;

a suction nozzle connected to an end of the extending tube and configured to suck outer air therein through;

an inner sound absorption member disposed around the fan motor to absorb noise generated by the fan motor;

a casing disposed around the inner sound absorption member to enclose the fan motor, the casing being provided with at least one receiving portion being projected outward corresponding to a shape of the brush fixing portion to receive the brush fixing portion therein, wherein a plurality of air holes are provided through the casing and have diameters that are at least substantially identical to each other, the plurality of air holes disposed in a predetermined pattern through at least one peripheral surface of the casing except the receiving portion, the predetermined pattern including a plurality of rows and a plurality of columns, wherein the at least one peripheral surface has a predetermined height and a predetermined width and the air holes are spaced from each other on the at least one peripheral surface, an outer sound absorption member disposed around the casing to absorb the noise generated by the fan motor, wherein the inner sound absorption member is made from a porous material and is disposed adjacent an inner surface of the casing, wherein the outer sound absorption member includes at least one receiving portion that projects outwardly corresponding to the shape of the brush fixing portion, the at least one receiving portion of the outer sound absorption member receiving the at least one receiving portion of the casing, and wherein a first radial distance between the at least one receiving portion of the outer sound absorption member and a central axis passing through the outer sound absorption member is greater than a second radial distance between a surface of the outer sound absorption member adjacent the at least one receiving portion at said first radial distance and said central axis.

2. The vacuum cleaner according to claim 1, wherein the casing is spaced apart from the fan motor.

3. The vacuum cleaner according to claim 1, wherein at least one of the inner sound absorption member or the outer sound absorption member is formed of one of sponge or cotton.

4. The vacuum cleaner according to claim 1, wherein a front end of the casing is spaced apart from a front end of the fan motor by a predetermined distance.

5. The vacuum cleaner according to claim 1, wherein the outer sound absorption member is about 5-15 mm thick, the casing is about 1-5 mm thick, the at least one air hole has a diameter of about 1-10 mm, and the inner sound absorption member is about 1-10 mm thick.

6. The vacuum cleaner according to claim 1, wherein the at least one receiving portion of the casing extends from an upper end of the casing or a lower end of the casing, and wherein the at least one receiving portion of the outer sound absorption member extends from an upper end or a lower end, respectively of the outer sound absorption member coincident with the upper and lower ends of the casing.

7. The vacuum cleaner according to claim 1, wherein the casing includes at least two receiving portions.

8. The vacuum cleaner of claim 7, wherein the outer sound absorption member redirects the air flow exhausted through the holes in the case so that the air flow passes through a hole in the outer sound absorption member in and axial direction relative to a rotating shaft of the motor.

9. The vacuum cleaner of claim 1, wherein an air flow path is established between the motor and at least one hole in the outer absorption member, the air flow path passing through a peripheral surface of the inner sound absorption member, through a plurality of air holes in the casing, and through the at least one hole in the outer absorption member, and wherein a portion of the air flow path passing from the motor and through the holes in the casing is substantially perpendicular to an axial direction of a rotating shaft of the motor, and wherein the surface forming at least one hole in the outer absorption member is at least substantially parallel to the radial direction of the rotating shaft.

10. The vacuum cleaner according to claim 1, wherein the casing includes first and second receiving portions and wherein the peripheral surface of the casing is located between the first and second receiving portions, and wherein the outer sound absorption member includes first and second receiving portions which receive the first and second receiving portions of the casing.

11. The vacuum cleaner according to claim 10, wherein the first and second receiving portions of the casing and outer sound absorption member are positioned at least substantially 180 degrees apart.

12. The vacuum cleaner according to claim 1, wherein the casing is made from a rigid material and the outer sound absorption member is made from a spongy polymer material.

13. The vacuum cleaner according to claim 12, wherein the spongy polymer material includes a synthetic foam body.

14. The vacuum cleaner according to claim 1, wherein a thickness of the inner absorption member and the diameter of the air holes are at least substantially equal.

15. The vacuum cleaner according to claim 14, wherein a thickness of the inner absorption member is within the range of 2-7 mm, a thickness of the outer sound absorption member is 10 mm, and a thickness of the casing is approximately 3 mm, and wherein the air holes have a diameter of 5 mm.

16. The vacuum cleaner according to claim 1, wherein a housing of the motor includes one or more exhaust windows and wherein the inner sound absorption member is located between the one or more exhaust windows of the motor housing and the plurality of holes in the casing along an airflow path that passes from the one or more exhaust windows, through the inner sound absorption member, and through the plurality of holes in the casing.

17. The vacuum cleaner according to claim 16, wherein the one or more exhaust windows are in alignment with the plurality of holes in the casing.

18. A vacuum cleaner, comprising:

a cylindrical fan motor, to a front portion of which air is introduced, the cylindrical fan motor comprising a motor that generates rotational force, an impeller that rotates via the rotational force generated by the motor unit, and a brush fixing portion that protrudes outward from a peripheral surface of the motor;

a casing disposed around the fan motor to enclose the fan motor, the casing being provided with at least one receiving portion that projects outward corresponding to a shape of the brush fixing portion to receive the brush fixing portion therein, wherein the casing includes a plurality of air holes having diameters that are at least substantially identical to each other and being spaced apart from each other through at least one peripheral surface of the casing except the receiving portion, the at least one peripheral surface having a predetermined height and a predetermined width;

a first sound absorption member adjacent an inner surface of the casing to absorb noise generated by the motor;

a second sound absorption member adjacent an outer surface of the casing;

a front supporting member that encloses front edges of the impeller;

a rear supporting member installed in a hole formed on a rear portion of the casing, wherein the first sound absorption member is made from a porous material, wherein the second sound absorption member includes at least one receiving portion projecting outwardly corresponding to the shape of the brush fixing portion, the at least one receiving portion of the second sound absorption member receiving the at least one receiving portion of the casing, and wherein a first radial distance between the at least one receiving portion of the second sound absorption member and a central axis passing through the second sound absorption member is greater than a second radial distance between a surface of the second sound absorption member adjacent the at least one receiving portion at said first radial distance and said central axis.

19. The vacuum cleaner according to claim 18, wherein a diameter of the at least one air hole is about 1-10 mm.

20. The vacuum cleaner according to claim 18, wherein the casing is formed of plastic having strength enough not to be deformed by air current exhausted from the fan motor.

21. The vacuum cleaner according to claim 18, wherein the first sound absorption member is formed of one of cotton or rubber.

22. The vacuum cleaner according to claim 18, wherein the casing is spaced apart from the fan motor by a predetermined distance.

23. The vacuum cleaner according to claim 18, further comprising a plurality of exhaust windows provided at an outer circumference of the motor to exhaust the air introduced through a front portion of the impeller.

* * * * *